US008393083B2

(12) United States Patent
Wu

(10) Patent No.: US 8,393,083 B2
(45) Date of Patent: Mar. 12, 2013

(54) ADJUSTABLE THINNING SCISSORS

(76) Inventor: Pei-Ling Wu, Taichung (TW)

( * ) Notice: Subject to any disclaimer, the term of this patent is extended or adjusted under 35 U.S.C. 154(b) by 357 days.

(21) Appl. No.: 12/756,909

(22) Filed: Apr. 8, 2010

(65) Prior Publication Data

US 2011/0247219 A1 Oct. 13, 2011

(51) Int. Cl.
*B26B 13/24* (2006.01)

(52) U.S. Cl. ..... 30/196; 30/195; 30/355

(58) Field of Classification Search ..... 30/89, 120, 30/631, 120.4, 162, 320, 155, 321, 341, 145, 30/194, 50, 355; 464/32; 7/135, 139, 131; 403/3, 4

See application file for complete search history.

(56) References Cited

U.S. PATENT DOCUMENTS

| | | | | |
|---|---|---|---|---|
| 2,511,187 | A * | 6/1950 | Weidauer | 30/230 |
| 2,564,786 | A * | 8/1951 | Lubbert | 408/97 |
| 4,074,430 | A * | 2/1978 | Sugiyama | 30/260 |
| 4,175,737 | A * | 11/1979 | Foss | 269/317 |
| 4,255,626 | A * | 3/1981 | Watts et al. | 200/6 A |
| 4,584,770 | A * | 4/1986 | Sabol | 30/267 |
| 4,610,585 | A * | 9/1986 | Fellmeth et al. | 409/233 |
| 5,125,159 | A * | 6/1992 | Brenton et al. | 30/232 |
| 5,722,171 | A * | 3/1998 | Schmidt | 30/255 |
| 6,131,291 | A * | 10/2000 | Mock | 30/266 |
| 6,651,345 | B1 * | 11/2003 | Adachi | 30/195 |
| 7,380,342 | B2 * | 6/2008 | Huang et al. | 30/194 |
| 2006/0095060 | A1 * | 5/2006 | Mayenberger et al. | 606/174 |
| 2010/0107420 | A1 * | 5/2010 | Makoto | 30/201 |

FOREIGN PATENT DOCUMENTS

| | | | |
|---|---|---|---|
| CN | 201333711 Y | * | 2/2010 |
| CN | 201395169 Y | * | 2/2010 |
| DE | 29620588 U1 | * | 4/1997 |
| EP | 1318254 A2 | * | 6/2003 |
| FR | 2312218 A | * | 1/1977 |
| GB | 2154922 A | * | 9/1985 |
| JP | 2009299754 A | * | 12/2009 |

OTHER PUBLICATIONS

CN 201395169 Y (Abstract and figure of CN201395169, retrieved from Derwent; Derwent Acc-No. 2010-B78245, Derwent Abstracted-Pub-No. CN 201395169 Y Inventor: Heng H et al.; Date: Feb. 2010.*

CN 201333711 Y (Abstract and figure of CN201395169, retrieved from Derwent; Derwent Acc-No. 2009-Q98805, Derwent Abstracted-Pub-No. CN 201333711 Y Inventor:Wu P; Date: Oct. 2009.*

* cited by examiner

*Primary Examiner* — Sean M. Michalski
*Assistant Examiner* — Fernando Ayala

(57) ABSTRACT

A thinning scissors of the present invention includes a first blade unit, a second blade unit, an adjusting button, a nut and a screw. The first blade unit has a first pivoting bore, and the second blade unit has a second pivoting bore. The adjusting button has an axle rotatably inserted in the first pivoting bore. The axle has an offset bore whose axis is offset from that of the axle. The nut is rotatably disposed in the offset bore, and the screw is inserted in the second pivoting bore and threaded with the nut. Thereby, the rotational axis of the first blade unit and that of the second blade relatively move as the adjusting button rotates in the first pivoting bore.

2 Claims, 4 Drawing Sheets

ADJUSTABLE THINNING SCISSORS

BACKGROUND OF THE INVENTION

1. Field of the Invention

The present invention relates to a scissors, and more particularly to a hair thinning scissors.

2. Description of the Prior Art

As shown in FIG. 1 to FIG. 3, a conventional thinning scissors has a first blade unit 10, a second blade unit 20, a nut 24 and a screw 14. The blade units 10 and 20 have protrusions 11, 21 and grooves 12, 22 arranged alternatively. Further, the first blade unit 10 has a first pivoting bore 13 for the nut 24 to dispose therein, and the second blade unit 20 has a second pivoting bore 23 for the screw 14 to insert therein and thread with the nut 24. Such conventional thinning scissors has fixed cutting width L, i.e. the width the protrusion 11 overlapping the protrusion 21 as shown in FIG. 3. As a result, the thinning ability of the scissors is fixed, which on the other hand means unadjustable.

The present invention is, therefore, arisen to obviate or at least mitigate the above mentioned disadvantages.

SUMMARY OF THE INVENTION

The main object of the present invention is to provide a thinning scissors whose thinning ability is adjustable.

To achieve the above and other objects, a thinning scissors of the present invention includes a first blade unit, a second blade unit, an adjusting button, a nut and a screw. The first blade unit has a first pivoting section, a first cutting blade and a first handle. The first pivoting section has a first pivoting bore. The first cutting blade extends frontward from the first pivoting section. The first cutting blade has a plurality of first protrusions and a plurality of first notches which are arranged alternatively along a longitudinal direction of the first cutting blade. The first handle extends rearward from the first pivoting section. The second blade unit has a second pivoting section, a second cutting blade and a second handle. The second pivoting section has a second pivoting bore. The second cutting blade extends frontward from the second pivoting section. The second cutting blade has a plurality of second protrusions and a plurality of second notches which are arranged alternatively along a longitudinal direction of the second cutting blade. The second handle extends rearward from the second pivoting section. The adjusting button has an axle rotatably inserts in the first pivoting bore. The axle has an offset bore whose axis is offset form an axis of the axle. The nut is rotatably disposed in the offset bore. The screw is inserted in the second pivoting bore and threaded with the nut.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
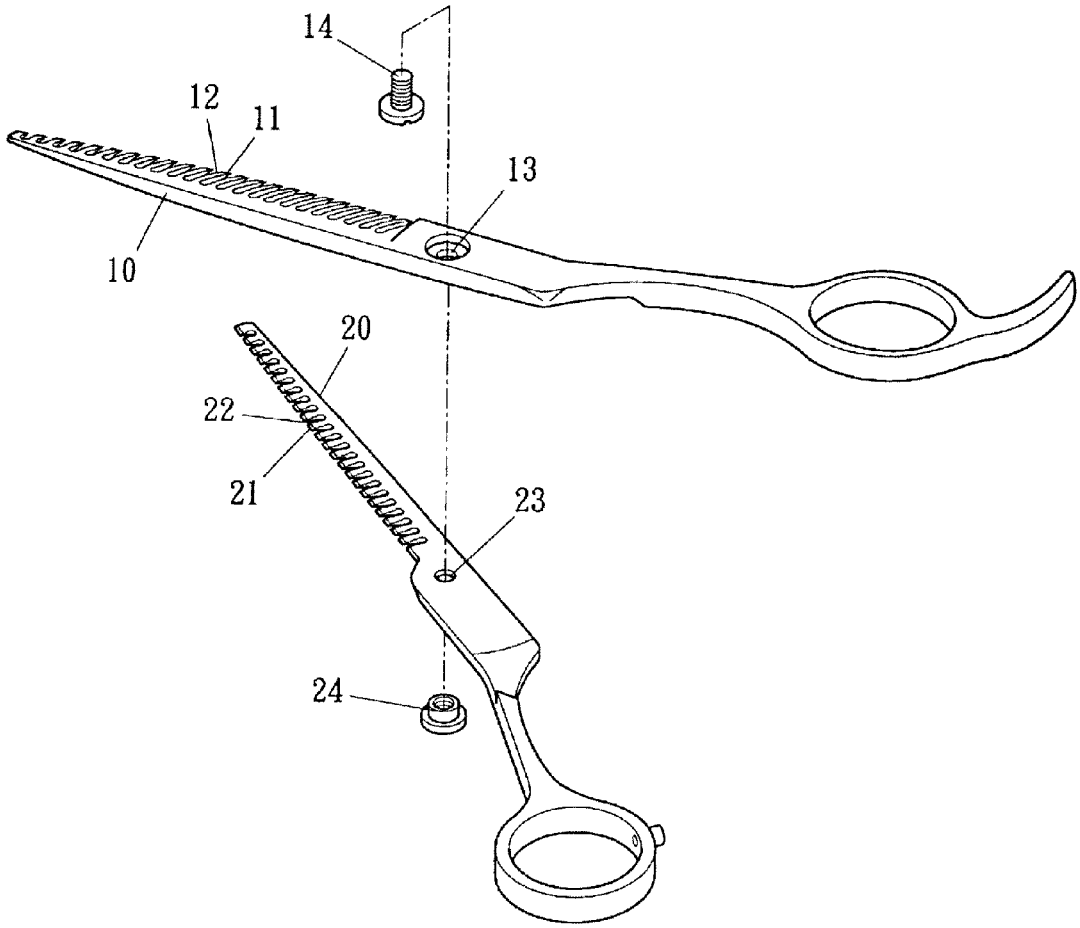
FIG. 1 PRIOR ART
FIG. 1 is a breakdown drawing showing a conventional thinning scissors.
Figure 2:
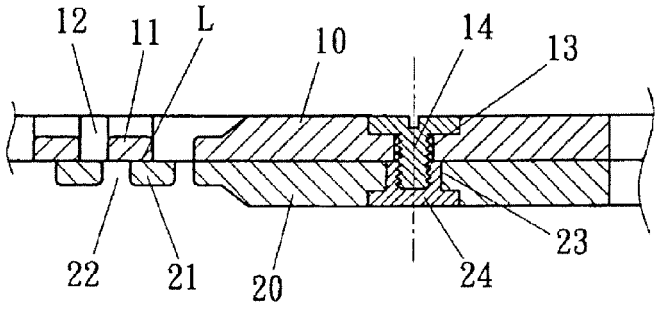
FIG. 2 PRIOR ART
FIG. 2 is a profile showing a conventional thinning scissors.
Figure 3:
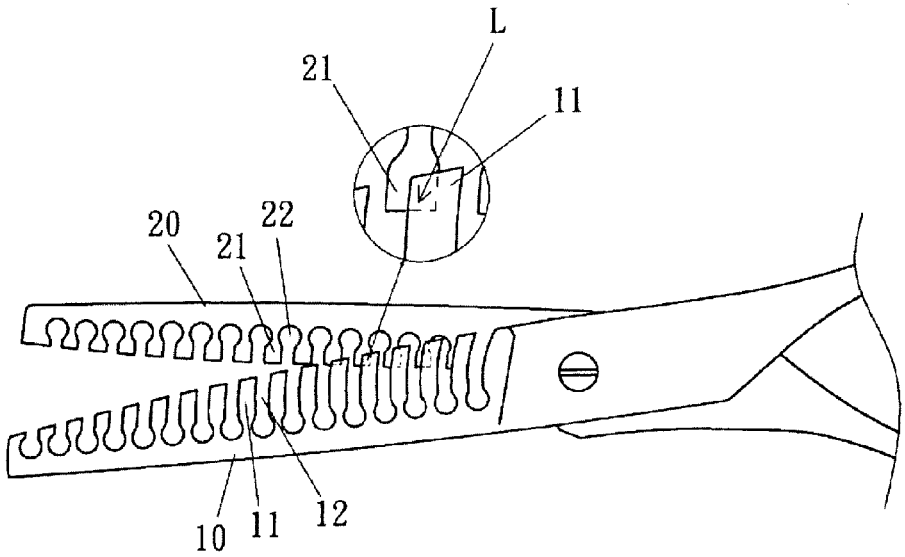
FIG. 3 PRIOR ART
FIG. 3 is an upper view showing a conventional thinning scissors.
Figure 4:
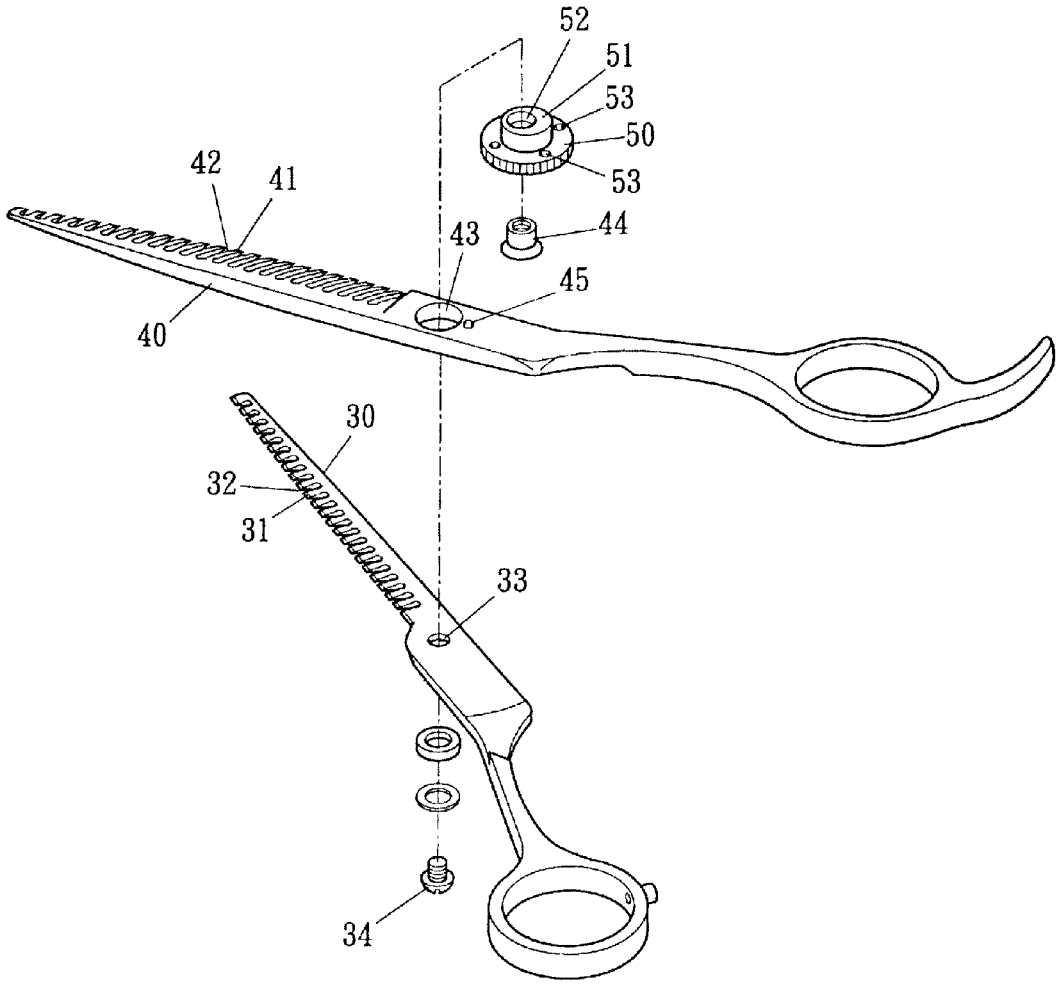
FIG. 4 is a breakdown drawing showing a thinning scissors of the present invention.

Please refer to FIG. 4 to FIG. 7. A thinning scissors of the present invention includes a first blade unit 40, a second blade unit 30, an adjusting button 50, a nut 44 and a screw 34.

Each blade unit 30, 40 has a pivoting section, a cutting blade and a handle. The pivoting section has a pivoting bore 33, 43. The cutting blade extends frontward from the pivoting section, and the cutting blade has a plurality of protrusions 31, 41 and a plurality of notches 32, 42 which are arranged alternatively along a longitudinal direction of the cutting blade. The handle extends rearward from the pivoting section and preferably has a hole for the user to hold with his/her finger(s). Furthermore, the first blade unit 40 has a first side and a second side, in which the first side contacts the second blade unit 30, and the second side is remote from the second blade unit 30. Preferably, the first pivoting bore 43 is tapered from the second side toward the first side.

Figure 5:
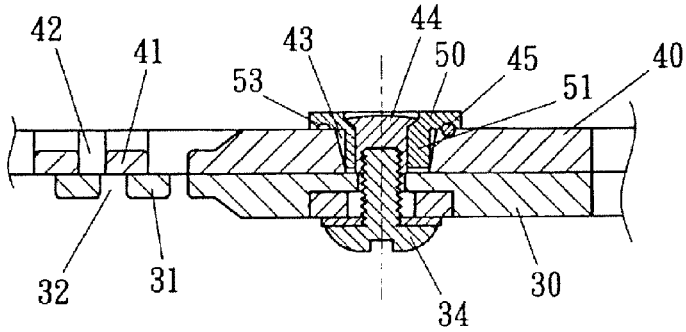
FIG. 5 is a profile showing a thinning scissors of the present invention.

The adjusting button 50 has an axle 51 rotatably inserted in the first pivoting bore 43, and the axle 51 has an offset bore 52 whose axis is offset from an axis of the axle 51. Preferably, the adjusting button 50 has a grip portion for the user to apply rotational force thereon. In addition, the axle 51 preferably has an outer diameter no bigger than the maximum bore diameter of the first pivoting bore 43 and no smaller than the minimum bore diameter of the first pivoting bore 34. As such, the axle 51 contacts the pivoting bore 43 in a line-contacting manner to reduce friction as shown in FIG. 5.

The nut 44 is rotatably disposed in the offset bore 52, and the screw 34 is inserted in the second pivoting bore 33 and threaded with the nut 44. Thereby, the blade units 30 and 40 are combined and are rotatable with respect to each other.

Figure 6:
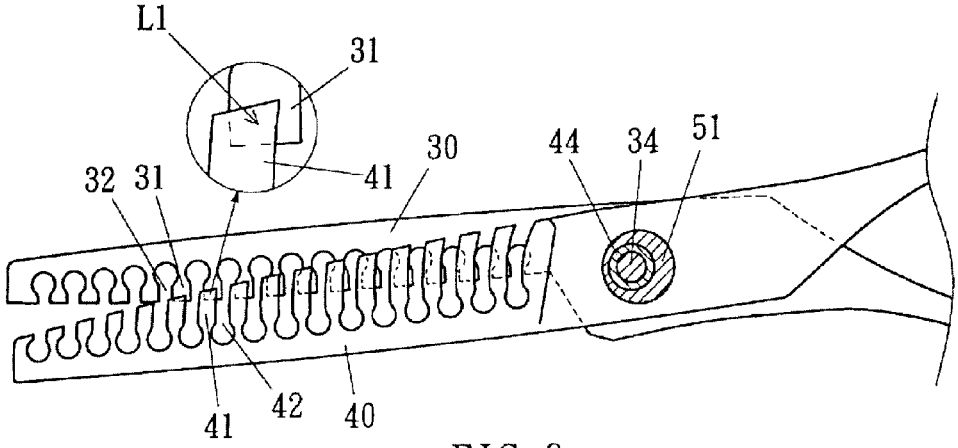
FIG. 6 is an upper view showing a thinning scissors of the present invention, wherein the scissors has a bigger cutting width.
Figure 7:
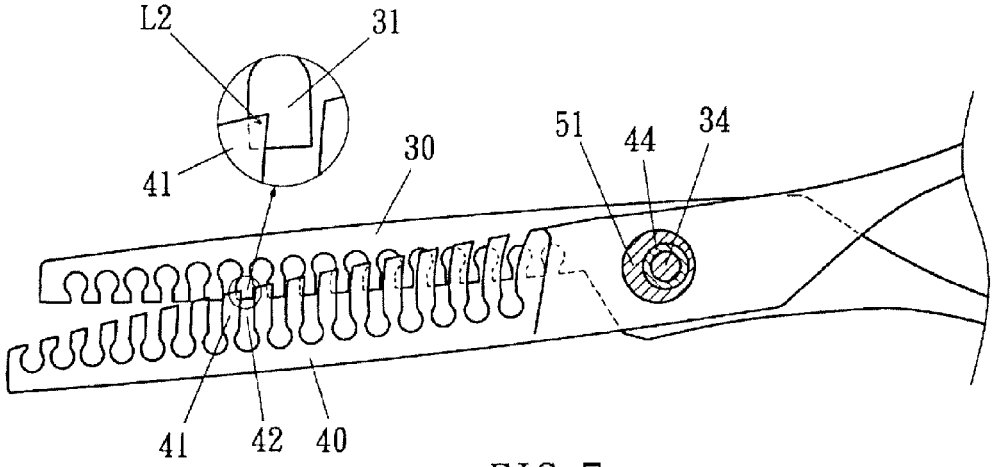
FIG. 7 is an upper view showing a thinning scissors of the present invention, wherein the scissors has a smaller cutting width.

The scissors further has a positioning mechanism, which has a protrusive boss 45 and several grooves 53. The protrusive boss 45 is selectively engaged with one of the grooves 53. The protrusive boss 45 is disposed on the first pivoting section (or the adjusting button 50) and is adjacent to the first pivoting bore 43. The grooves 53 are disposed on the adjusting button 50 (or the first pivoting section) and are arranged to surround the first pivoting bore 43. As such, the protrusive boss is selectively received in one of the grooves 53 as the adjusting button 50 rotates with respect to the first pivoting bore 43. It is to be noted that the axis of the offset bore 52, which is also the rotational axis of the second blade unit, is movable with respect to the first pivoting bore 43 as the adjusting button 50 rotates. Thereby, the cutting width L1, L2 can be adjusted to be wider, as shown in FIG. 6, or more narrow, as shown in FIG. 7. The thinning ability of the scissors is, therefore, adjusted as well.

What is claimed is:

1. An adjustable thinning scissors, comprising a first blade unit, having a first pivoting section, a first cutting blade and a first handle, the first pivoting section having a first pivoting bore, the first cutting blade extending frontward from the first pivoting section, the first cutting blade having a plurality of first protrusions and a plurality of first notches, the first protrusions and first notches being arranged alternatively along a longitudinal direction of the first cutting blade, the first handle extending rearward from the first pivoting section;

a second blade unit, having a second pivoting section, a second cutting blade and a second handle, the second pivoting section having a second pivoting bore, the second cutting blade extending frontward from the second pivoting section, the second cutting blade having a plurality of second protrusions and a plurality of second notches, the second protrusions and the second notches being arranged alternatively along a longitudinal direction of the second cutting blade, the second handle extending rearward from the second pivoting section;

an adjusting button, having an axle rotatably inserted in the first pivoting bore, the axle having an offset bore whose axis is offset from an axis of the axle;

a nut, rotatably disposed in the offset bore; and a screw, inserted in the second pivoting bore and threaded with the nut, wherein the first blade unit has a first side and a second side, the first side contacts the second blade unit, the second side is remote from the second blade unit, the first pivoting bore is tapered from the second side toward the first side, cross-sections of the axle from the first side to the second side are substantially of a fixed diameter, the fixed diameter is larger than that of an opening of the first pivoting bore at the first side and smaller than that of an opening of the first pivoting bore at the second side, a common edge of a circumferential surface and a surface which faces the second blade unit of the axle contacts a side surface in the first pivoting bore, and the circumferential surface is substantially disengaged with the side surface.

2. The adjustable thinning scissors of claim 1, further comprising a positioning mechanism, the positioning mechanism having a protrusive boss and several grooves, the protrusive boss being selectively engaged with one of the grooves, the protrusive boss being disposed on one of the first pivoting section and the adjusting button and being adjacent to the first pivoting bore, the grooves being disposed on the other of the first pivoting section and the adjusting button and surrounding the first pivoting bore.

* * * * *